US012016372B2

(12) United States Patent
Capo et al.

(10) Patent No.: US 12,016,372 B2
(45) Date of Patent: Jun. 25, 2024

(54) METHOD AND APPARATUS TO CAST A WEB OF MATERIAL CONTAINING ALKALOIDS

(71) Applicant: PHILIP MORRIS PRODUCTS S.A., Neuchatel (CH)

(72) Inventors: Silvia Capo, Capaccio-Paestum (IT); Rui Nuno Batista, Morges (CH)

( * ) Notice: Subject to any disclaimer, the term of this patent is extended or adjusted under 35 U.S.C. 154(b) by 534 days.

(21) Appl. No.: 17/251,862

(22) PCT Filed: Jun. 28, 2019

(86) PCT No.: PCT/EP2019/067441
§ 371 (c)(1),
(2) Date: Dec. 14, 2020

(87) PCT Pub. No.: WO2020/002657
PCT Pub. Date: Jan. 2, 2020

(65) Prior Publication Data

US 2021/0244075 A1 Aug. 12, 2021

(30) Foreign Application Priority Data

Jun. 29, 2018 (EP) ..... 18181005

(51) Int. Cl.
*A24B 3/14* (2006.01)
*A24B 15/14* (2006.01)
*A24C 5/01* (2020.01)

(52) U.S. Cl.
CPC ..... *A24B 3/14* (2013.01); *A24B 15/14* (2013.01); *A24C 5/01* (2020.01)

(58) Field of Classification Search
CPC ..... A24C 5/01; A24B 15/14; A24B 3/14
See application file for complete search history.

(56) References Cited

U.S. PATENT DOCUMENTS 3,649,446 A 3/1972 Makela
5,730,318 A * 3/1998 Schramm ..... A24C 5/356 221/266

(Continued)

FOREIGN PATENT DOCUMENTS

CN 202983539 U 6/2013
CN 203899867 U 10/2014

(Continued)

OTHER PUBLICATIONS

Search Report and Written Opinion for PCT/EP2019/067441 dated Sep. 25, 2019 (10 pages).

(Continued)

*Primary Examiner* — Christopher M Rodd
*Assistant Examiner* — Jennifer A Kessie
(74) *Attorney, Agent, or Firm* — Mueting Raasch Group

(57) ABSTRACT

The invention relates to a casting apparatus (100) to cast a web (1) of a material containing alkaloids, the casting apparatus (100) including: —a casting box (10) adapted to contain a slurry (2) to be cast to form the web (1) of a material containing alkaloids, the casting box (10) defining one or more lateral walls (11, 14); —a slidable lid (80) adapted to slide on the one or more lateral walls (12,14) of the casting box (10); —a movable support (20); and —a casting blade (70) adapted to cast the slurry (2) contained in the casting box (10) onto the movable support (20) so as to form the cast web (1). The invention also relates to a method to cast a web of a material containing alkaloids.

15 Claims, 2 Drawing Sheets

(56) References Cited

U.S. PATENT DOCUMENTS

| | | | | |
|---|---|---|---|---|
| 10,575,549 | B2 | 3/2020 | Hock | |
| 10,813,381 | B2 | 10/2020 | Klipfel | |
| 2012/0180529 | A1* | 7/2012 | Singer | B01F 27/0724 366/302 |
| 2020/0022408 | A1* | 1/2020 | Kolyris | A24F 1/30 |

FOREIGN PATENT DOCUMENTS

| | | | |
|---|---|---|---|
| CN | 105710002 | A | 6/2016 |
| CN | 107249359 | A | 10/2017 |
| GB | 899 565 | | 6/1962 |
| GB | 01233999 | | 6/1971 |
| JP | 2017-534266 | | 11/2017 |
| WO | WO 2016/096963 | | 6/2016 |
| WO | WO 2017/001352 | | 1/2017 |
| WO | WO 2017/089589 | | 6/2017 |

OTHER PUBLICATIONS

Office Action issued in Japan for Application No. 2020-570829 dated Jun. 22, 2023 (10 pages). English translation included.
Office Action issued in China for Application No. 201980043032.0 dated Mar. 2, 2022 (16 pages).

* cited by examiner

METHOD AND APPARATUS TO CAST A WEB OF MATERIAL CONTAINING ALKALOIDS

This application is a U.S. National Stage Application of International Application No. PCT/EP2019/067441 filed Jun. 28, 2019, which was published in English on Jan. 2, 2020 as International Publication No. WO 2020/002657 A1. International Application No. PCT/EP2019/067441 claims priority to European Application No. 18181005.2 filed Jun. 29, 2018.

This invention relates to a casting apparatus and method for producing a cast web of a material containing alkaloids.

In particular, the material containing alkaloids is homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf (TCL is the acronym for tobacco cast leaf). The process to form homogenized tobacco material sheets commonly comprises a step in which tobacco dust and a binder, are mixed to form a tobacco slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for the control for example, of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of web of homogenized tobacco. A non-optimal casting method and apparatus may lead to inhomogeneity and defects in the cast web of homogenized tobacco.

Inhomogeneity in the homogenized tobacco web may lead to difficulties in subsequent handling of the homogenized tobacco web in the production of the aerosol-generating article. For example, inhomogeneity may lead to tearing of the web or even rupture of the web during manufacture or further processing of the web. This in turn could, for example, result in machine stops. Additionally, an inhomogeneous tobacco web may create unintended difference in the aerosol delivery between aerosol generating articles that are produced from the same homogenized tobacco web.

Regarding the overall manufacturing process of web of homogenized tobacco material, different parameters are important for the final product quality and consistency. One of this parameters is the pressure of the slurry inside the casting box. Even a slight variation of pressure from one slurry production batch to another could alter the homogeneity of the web of homogenized tobacco material that may be rejected according to the tight quality standards of the industry.

There is a need for a casting apparatus and method for the production of a cast web of a material containing alkaloids that is adapted to overcome, or at least considerably decrease, the above-mentioned issue. Further, it would be advantageous to have a casting apparatus and method where a good control of the pressure in the casting box can be achieved.

The invention relates to a casting apparatus to cast a web of a material containing alkaloids, the casting apparatus including: a casting box adapted to contain a slurry to be cast to form the web of a material containing alkaloids, the casting box defining one or more lateral walls; a slidable lid apt to slide on the one or more lateral walls of the casting box; a movable support; and a casting blade adapted to cast the slurry contained in the casting box onto the movable support so as to form the cast web.

The presence of a slidable lid on the casting box allows a better control of a pressure value inside the casting box and may reduce the presence of "dry slurry patches" that may form at the surface of the slurry exposed to air. The dry slurry patches are an inhomogeneity that may not dissolve in the slurry before casting, causing inhomogeneity in the cast sheet.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "casting blade" denotes a longitudinally shaped element that may have an essentially constant cross-section along major parts of its lengthwise extension. It shows at least one edge that is intended to come into contact with a pasty, viscous or liquid-like substance to be influenced by said edge, such as a slurry. Said edge may have a sharp and knife-like shape. Alternatively, the edge of the blade may have a rectangular or a rounded shape.

As used herein, the term "movable support" denotes any means comprising a surface that can be moved in at least one longitudinal direction. The movable support may form a closed loop so as to provide an uninterrupted transporting ability in one direction. However, the movable support may be moved in back and forth moving way as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and bendable band. The band may be made of a metallic material, including but not limited to steel, copper, iron alloys and copper alloys, or of a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The homogenized tobacco sheet material can be also referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The slurry may comprise a number of different components or ingredients. These components may influence the properties of the cast web of material containing alkaloids. A first ingredient is a material containing alkaloids, for example in powder form. This material can be for example a tobacco powder blend, which preferably contains the majority of the tobacco present in the slurry. The tobacco powder blend is the source of the majority of tobacco in the homogenized tobacco material and thus gives the flavor to the final product, for example to an aerosol produced by heating the homogenized tobacco material. A cellulose pulp containing cellulose fibers is preferably added to the slurry in order to increase the tensile strength of the alkaloids material web, acting as a strengthening agent. A binder may be added. An aerosol-former may be added. Binder and aerosol-former are preferably added in order to enhance the tensile properties of the homogenized sheet and promote the formation of aerosol. Further, in order to reach a certain viscosity and moisture optimal for casting the web of material containing alkaloids, water may be added to the slurry.

The quantity of binder added to the slurry may be comprised between about 1 percent and about 5 percent in dry weight of the slurry. More preferably, it is comprised between about 2 percent and about 4 percent. The binder used in the slurry may be any of the gums or pectins described herein. The binder may ensure that the tobacco powder remains substantially dispersed throughout the homogenized tobacco web. Although any binder may be employed, preferred binders are natural pectins, such as fruit, citrus or tobacco pectins;

guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

The introduction of cellulose fibres in the slurry typically increases the tensile strength of the tobacco material web, acting as a strengthening agent. Therefore, adding cellulose fibres may increase the resilience of the homogenized tobacco material web. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively, fibres, such as vegetable fibres, may be used either with the above fibres or in the alternative, including hemp and bamboo. The length of cellulose fibres is advantageously between about 0.2 millimetres and about 4 millimetres. Preferably, the mean length per weight of the cellulose fibres is between about 1 millimetre and about 3 millimetres. Further, preferably, the amount of the cellulose fibres is comprised between about 1 percent and about 7 percent in dry weight basis of the total weight of the slurry (or homogenized tobacco sheet).

Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerine and propylene glycol.

The slurry may have an aerosol-former content of greater than about 5 percent on a dry weight basis. The slurry may have an aerosol former content of between about 5 percent and about 30 percent by weight on a dry weight basis. More preferably, the aerosol-former is comprised between about 10 percent to about 25 percent of dry weight of the slurry. More preferably, the aerosol-former is comprised between about 15 percent to about 25 percent of dry weight of the slurry.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

Preferably, the alkaloid containing material is tobacco. The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The apparatus of the invention includes a casting box to contain the slurry and a movable support where the slurry is cast by means of a casting blade.

The slurry may reach the casting box from a different location. The casting box therefore might not be the place where the slurry is formed. For example, the slurry may be created in a silo or tank, from where it is transferred to the casting box via suitable piping. Preferably, the slurry is continuously supplied to the casting box while the slurry is cast onto the movable support to form a continuous web of material containing alkaloids. The silo and the casting box are thus preferably fluidly connected in order to allow the slurry flow from one to the other.

The slurry is then collected in a casting box, in which a pre-defined amount of slurry is preferably maintained, for example a pre-determined level of slurry within the casting box is set. Preferably, slurry is continuously supplied to the casting box while the slurry is cast onto the movable support.

The casting-box is preferably box-shaped. Preferably, the casting box includes walls. More preferably, the walls in turn comprise sidewalls. The sidewalls may include a first and a second couple of opposite walls. The first couple may include two sidewalls called first, and second sidewalls, while the second couple may include third and fourth sidewalls. The sidewalls are preferably substantially vertical, or tilted with respect to a vertical plane. The two sidewalls in each of the first and second couple are preferably one facing the other. Preferably, the walls of the casting box also include a bottom wall which has an aperture. Preferably, the whole bottom wall defines an aperture.

The walls of the casting box define an inner volume of the casting box itself, that is, the walls delimit an inner volume of the casting box. As mentioned, the casting box may include an aperture in a bottom portion, such as at the bottom wall, so that the casting box is not a completely closed container. The aperture is provided to cast the slurry. The inner volume of the casting box is thus in contact with the outside. Due to the presence of the aperture, the inner volume of the casting box is considered as the volume of a "theoretical" box where the area defined by the aperture is closed. The demarcation line between the inner volume of the box and the outside is therefore preferably made considering the aperture closed by a wall. The aperture may be formed in more than one wall (for example, corner apertures, which are apertures formed at the corners of the box). Further, more than a single aperture might be present in the casting box. The inner volume is considered as the volume inside the box defined by the walls in which all apertures are "virtually closed" by a geometrical continuation of the existing walls.

The casting blade is preferably arranged perpendicular to the casting direction. The web of material is formed by means of the casting blade that casts the slurry present from the casting box into the movable support. The slurry for example from the casting box comes into contact with the casting blade. An edge of the casting blade forms a gap with the surface of the movable support and the slurry passes through the aperture defined by said gap. The thickness of the cast web of material may be determined, among others, by the distance between the edge of the casting blade that comes into contact with the slurry and the surface of the movable support, that is, by the dimension of the above defined gap.

The casting blade is partly located outside the casting box facing the movable support.

Further, the casting box includes a slidable lid. The lid is connected to the casting box and it is capable of performing movements sliding on one or more of the lateral walls of the casting box. Preferably, the movement of the lid during the sliding is a substantially vertical movement. Preferably, the movement of the lid during the sliding is a substantially linear movement. More preferably, the slidable lid includes an external surface, which is the surface facing the outside when the lid in mounted to the casting box, an inner surface, which is the surface facing the slurry when the slidable lid is mounted on the casting box and a lateral perimetral surface, which is the surface connecting the external and inner surface. Preferably, the perimetral surface is substantially perpendicular to the inner and external surfaces.

Preferably, the slidable lid is adapted to slide on the one or more lateral walls of the casting box in order to change an inner volume of the casting box.

Even more preferably, the casting box walls and the slidable lid are in contact all around the perimetral surface. The dimension of the casting box sidewalls and of the lid are thus preferably matching so that the contact between the perimetral surface and the sidewalls of the casting box is possible substantially in all points.

The slidable lid preferably is located facing the aperture formed in the bottom portion of the casting box, and preferably also facing the movable support. Preferably, the slidable lid is substantially horizontal.

Preferably, the perimetral surface may include sealing elements to seal the slidable lid on the casting box. Sliding of the slidable lid is possible also when the casting box is sealed. The seal element may be attached to a portion of the slidable lid inserted into the casting box and is used to hermetically seal a gap between the casting box sidewalls and the slidable lid.

The sliding of the slidable lid along the sidewalls of the casting box might be due to a free floating of the lid on the slurry, that is, the slidable lid moves up and down depending on the position of the slurry level, so that the slidable lid is floating on the slurry and, if the slurry level rises, the lid goes up as well.

Further, the slidable lid may be removed to open or close the top part of the casting box.

The slidable lid may be actuated by a suitable actuator and thus it may function as a piston that is inserted into the top part of the casting box and is vertically slidable by pressure of slurry injected into the casting box.

The slidable lid therefore may be in contact to the slurry or. an air gap may be present between the slurry and the lid.

The presence of the slidable lid allows controlling the pressure inside the casting box. Due to the slidable lid presence, a pressurized container can be formed. Because the slidable lid can be moved, different quantities of slurry can be accommodated in the casting box or different pressures can be set as well. The slidable lid may also prevent the formation of "dry spots" of slurry on the slurry surface exposed to air.

The presence of the slidable lid may enable a control of the pressure and flow of the slurry inside the casting box. This control has a minimal impact or effect on the casting process, namely it does not modify (or only minimally) the conditions at the casting gap between the surfaces of the movable support and the casting blade, while assuring an adequate mixing effect of the slurry which has its natural movement inside the casting box.

Using the slidable lid, direct contact between the slurry and air may be avoided, minimizing oxidation and chemical/biological reactions in the slurry, including fermentation, mainly in spots where the slurry has slow movement and/or remains static for long period of time.

Preferably, the slidable lid includes a sealing element to seal the casting box. Preferably, the sealing element is part of the perimetral surface, that is, the location of the sealing element is on the side of the slidable lid, in contact to the sidewalls of the casting box. In this way, the pressure value inside the casting box can be controlled. Preferably, the inner volume of the casting box becomes sealed.

More preferably, the sealing element is coated or formed in graphene. Graphene allows obtaining at the same time good sealing properties and a smooth sliding of the slidable lid on the casting box walls, in particular for a floating slid.

Preferably, the slidable lid or the casting box includes a pressure valve in order to control a pressure value within the casting box. The valve may be set to a specific pressure, so that if the pressure value inside the casting box is too high, the valve prevents overpressure discharging air and/or slurry from the casting box.

Preferably, the pressure inside the casting box is maintained at a value comprised between about 1 bar and about 10 bar, more preferably between about 1 bar and about 5 bar, even more preferably between about 1 bar and about 3 bar.

Preferably, the casting box includes a plurality of fins, the fins being connected to the slidable lid. Without being bound by theory, the slurry has probably a shear-thinning behavior, that is, there is an inverse proportion between the natural viscosity of the slurry and the shear strain imposed. Thus, a good mixing of the slurry inside the casting box may be beneficial in the manufacturing process, in particular to control the thickness of the cast sheet. For this reason, preferably, fins which affect the flow of the slurry are inserted in the casting box. The fins, which may have a blade-like form, advantageously work as a mass distributor, as well as static mixing elements, as the slurry during its flow has to contour those fins, dispersing itself and creating non-linear flows. The slurry therefore has a "complex local movement" around the fins and at the same time an overall global movement flowing and moving, by the movement of the conveying belt, towards the casting blade.

This way, a linear flow is avoided as much as possible, also in the region where the slurry goes through the thin gap between the casting blade and the conveying belt. According to the experience in production, longitudinal (in reference to the casting direction) linear flows of the slurry feeding the casting box, and/or inside the casting box, can be correlated with linear transversal inconsistency of the cast sheet of material, namely in terms of its thickness, physical characteristics, and visual appearance. The specific geometry, size, number and relative proximity between the fins enable to define their effects in the flow of the slurry. These parameters may be designed by computer simulations, given the outline of the casting box and the characteristics of the slurry.

Preferably, the fins are attached to the slidable lid, so that movements of the lid in its sliding correspond to sliding movements of the fins. Having the fins attached to the slidable lid allows an easy extraction of the same (together with the lid) for repair or cleaning purpose. It also allows changing their vertical location rather easily.

More preferably, the casting box includes a regulation device to change the orientation of the fins, said orientation device being located on a surface of the slidable lid external to the casting box. The fins may have an elongated shape so that a major longitudinal axis is defined. It may be advantageous to be able to change the orientation of this major longitudinal axis depending on process or slurry parameters. A regulation device is for example positioned on the external surface of the slidable lid to perform such a regulation.

Preferably, the casting box includes an inlet for the slurry, the inlet for the slurry being formed in one of the sidewalls. An insertion of slurry from one of the sidewalls, instead for example from an insertion from above, may further improve the homogeneity of the slurry because it may minimize or limit the formation of air bubbles inside the slurry itself. Further, it removes the complexity of having a slurry feeding tube going through a movable lid. The insertion of additional slurry in the casting box, via an inlet, is preferably performed below a given level of slurry in the casting box. Preferably, the given level of slurry in the casting box is kept substantially constant at a specified height or within a specified height's range. Therefore, advantageously, while casting, there is a continuous flow of new slurry which is brought into the casting box via suitable piping. If the slurry is added in such a way that it fells onto the casting box, the slurry falling through air may incorporate air bubbles, which may cause defects in the cast web. With an inlet positioned in a sidewall below the given slurry level, air bubbles are difficult to form.

Preferably, the slidable lid is substantially horizontal. More preferably, the slidable lid is plate-like. Advantageously, the external and inner surfaces of the slidable lid are parallel and substantially horizontal.

The invention also relates to a method to cast a web of a material containing alkaloids, the method comprising: providing a casting box defining one or more lateral walls; providing a casting blade connected to the casting box; providing a movable support facing the casting blade; introducing the slurry in the casting box up to a level; covering the casting box with a slidable lid floating on the slurry, so that the slidable lid changes position when the slurry changes level in the casting box or when a pressure value in the casting box is changed;

and casting the slurry on the movable support by means of the casting blade to form the web of material containing alkaloids.

The advantages of the method of the invention have been already described above and not repeated.

The slidable lid can float on the slurry so that it follows the height variations of the slurry.

Preferably, the method includes the step of sealing the slidable lid onto the casting box. Preferably, the sealing takes place using a sealing element at the perimetral surface of the slidable lid.

Preferably, the method includes the step of changing the pressure value inside the casting box. The pressure value inside the casting box can be controlled thanks to the sealing of the slidable lid. The pressure can be changed changing the slidable lid position or regulating one or more pressure valves. Preferably, inside the casting box, the pressure value is maintained within a range of between about 1 bar and about 10 bar, more preferably between about 1 bar and about 5 bar, even more preferably between about 1 bar and about 3 bar.

Preferably, the method includes the step of providing a plurality of fins attached to the slidable lid. Preferably the fins are attached to the inner surface of the slidable lid so that they are in contact to the slurry during the slurry flow towards the casting blade.

Preferably, the method includes the step of changing the orientation of the fins. Depending on the geometry of the casting box, the characteristics of the slurry and the desired characteristics of the cast web, the orientation of the fins can be changed accordingly.

Preferably, the step of introducing the slurry inside the casting box includes the step of introducing the slurry in the casting box along a feeding direction, the feeding direction forming an angle with a horizontal plane comprised between about −45 degrees and about +45 degrees.

A substantially horizontal feeding of the slurry may avoid "gravity effect" and related flow variations during slurry feeding, and enables a better mixing effect in reference to the use of the fins, as well as it simplifies the overall design of the casting box, eliminating parts and structural elements, as well as simplifying cleaning.

Preferably, the cast sheet of a material containing alkaloids includes a homogenized tobacco sheet.

The invention may also relate to a casting apparatus to cast a web of a material, the casting apparatus including a casting box apt to contain a slurry to be cast to form the web, the box defining one or more lateral walls; a slidable lid apt to slide on the one or more lateral walls of the casting box in order to change an inner volume of the casting box; a movable support;

and a casting blade apt to cast the slurry contained in the casting box onto the movable support so as to form the cast web.

The invention may also relate to a method to cast a web of a material, the method comprising: providing a casting box defining one or more lateral walls; providing a casting blade outside the casting box; providing a movable support facing the casting blade;

introducing the slurry in the casting box up to a level; covering the casting box with a lid floating on the slurry, so that the lid changes position when the slurry changes level in the casting box or when a pressure value in the casting box is changed; and casting the slurry on the movable support by means of the casting blade to form the web of material.

Further advantages of the invention will become apparent from the detailed description thereof with no-limiting reference to the appended drawings wherein.

Figure 1:
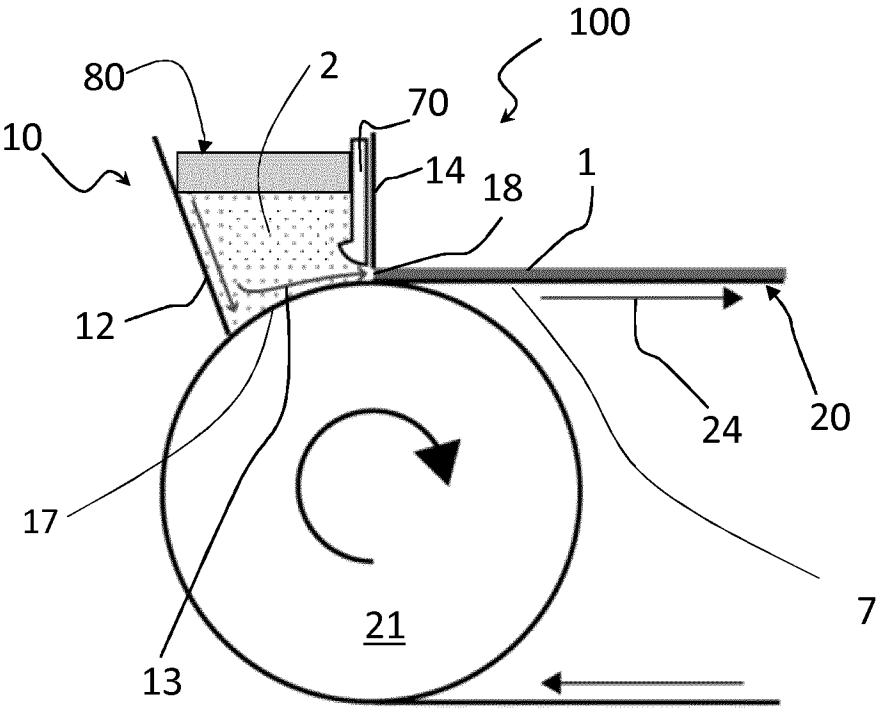
FIG. 1 is a schematic lateral section view of a first embodiment of the apparatus for the production of a web of a material containing alkaloids.
Figure 2:
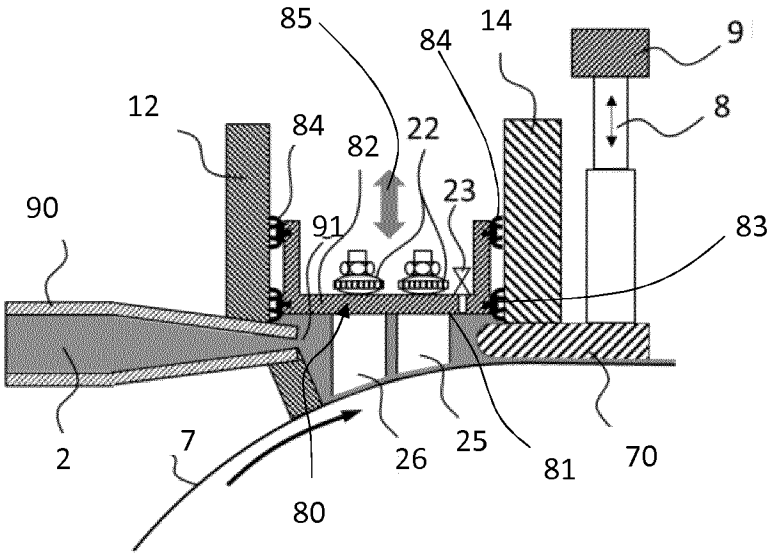
FIG. 2 is schematic lateral section view of a portion of the apparatus of FIG. 1.

With reference to FIGS. 1 and 2, a first embodiment of a casting apparatus for the production of a cast web of a material containing alkaloids according to the present invention is represented and indicated with reference number 100. Only a portion of the casting apparatus 100 is shown in FIGS. 1 and 2.

In particular, the casting apparatus 100 is adapted for the production of a cast web of a homogenized tobacco material 1.

The casting apparatus 100 comprises a casting box 10 containing slurry 2 and a movable support 20, wherein a casting blade 70 casts the slurry 2 contained in the casting box 10 onto the movable support 20 so as to form the cast sheet 1 of homogenized tobacco material.

Slurry 2 from buffer tanks (not shown in the drawings) is transferred into the casting box 10 usually by means of a pump (not shown in the drawings). Preferably, the pump comprises a control (not visible in the drawing) of flow rate to control the amount of slurry 2 introduced in the casting box 10. The pump is advantageously designed to ensure that slurry transfer times are kept to the minimum necessary. The pump is fluidly connected, for example by means of a piping 90 (see FIG. 2), to the casting box 10 so as to feed the same with the slurry 2.

The casting box 10 comprises sidewalls including a first and a second opposite walls 12, 14. The casting blade 70 is associated to the casting box 10 at the second wall 14. The casting box 10 is generally defined by four side walls, i.e. the first and second opposite walls 12, 14 and a third and a fourth opposite walls (not shown in the figures), which connect the first and second opposite walls 12, 14.

The amount of slurry 2 in the casting box 10 has a pre-determined level, which is preferably kept substantially constant so that the pressure exerted by the column of slurry 2 remains substantially the same. In order to keep the amount of slurry 2 substantially at the same level, the pump controls the flow of slurry 2 to the casting box 10.

The movable support 20 comprises for example a continuous stainless steel belt 7 including a drum assembly. The drum assembly includes a main drum 21 located below the casting box 10 which moves the movable support 20. Preferably, the casting box 10 is mounted on top of the main drum 21.

The slurry is casted on the steel belt 7—at the drum 21—through the casting blade 70, which creates a continuous sheet 1 of homogenized tobacco material. In order for the slurry to reach the casting blade and thus the movable support, the casting box 10 has an opening or aperture 17 in correspondence of its bottom and the opening 17 extends along a width of the casting box 10. The opening 17 is positioned over and in proximity of the drum 21.

The movement of the steel belt 7 forwards the slurry 2 towards the casting blade 70 at a front exit 18 of the casting box 10 (at the second wall 14). This flow is depicted with arrow 13 in FIG. 1. The casting blade 70 casts a part of the slurry 2 on the steel belt 20, while the remaining majority of the slurry 2 turns back and recirculates inside the casting box 10. The steel belt 20 moves along a casting direction depicted by arrow 24 in FIG. 1.

The casting blade 70 has a dominant dimension which is its longitudinal width. The casting blade 70 is for example substantially rectangular. The casting blade 70 is attached to the casting box 10 preferably by means of an adjustable board 8 operated by an actuator 9 (shown in FIG. 2) which allows a precise control of the position of the casting blade 70.

Between the casting blade 70 and the steel belt 20 a gap is present, the dimensions of which determine—among others—the thickness of the cast web of homogenized tobacco material.

The casting box 10 of the invention comprises also a slidable lid 80. With now reference to FIG. 2, the slidable lid includes an inner surface 81 facing or in contact to the slurry, an external surface 82 and a perimetral surface 83. The perimetral surface 83 is in contact with the sidewalls 12, 14 of the casting box 10. Preferably, the perimetral surface 83 is in contact with all sidewalls. The size of the inner surface 81 is such that it preferably matches with the area delimited by the sidewalls of the casting box 10.

The slidable lid 80 may slide on the sidewalls thanks to sealing elements 84 formed in graphene and positioned at the perimetral surface 83. The presence of the graphene sealing elements 84 seals the slidable lid on the casting box 10, defining a pressurized container. In order to be able to vary the pressure value inside such a pressurized container, a valve (or more than a valve) 23 is positioned on the external surface 82 of the slidable lid. The maximum value of acceptable pressure can be changed on the valve 23.

Further, a first and a second row 25, 26 of fins extend from the inner surface 83 of the slidable lid towards the slurry 2. The two rows of fins are preferably one parallel to the other and are attached to the slidable lid 80. On the opposite side of the lid that carrying the fins, that is, on the external surface 82, a first and a second regulation devices, both indicated by 22, are accessible by a user and can be used to rotate the fins 25, 26. Regulation devices 22 may include knobs.

Figure 3:
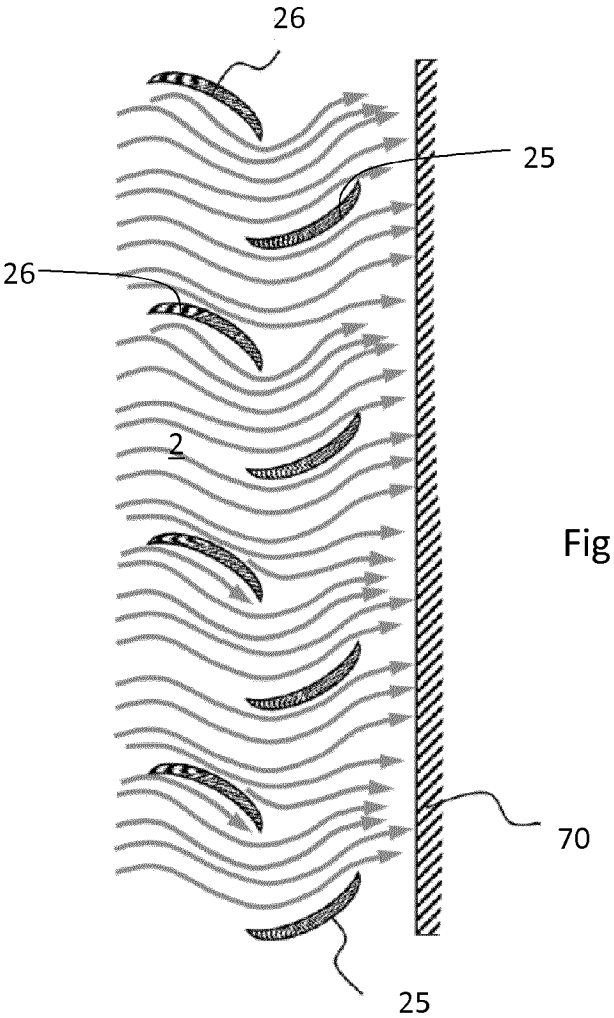
FIG. 3 is a schematic bottom view of a detail of the apparatus of FIG. 2.

FIG. 3 shows the rows of fins in an enlarged bottom view. Each fin 25, 26 has a C shape, where the concavity of the C is positioned substantially facing the main direction of flow of the slurry. In other words, fins 25, 26 all have the same shape and all defines a major dimension, which is positioned substantially parallel to each other within the same row.

The casting box 10 further includes piping 90 (visible only in FIG. 2), for the transfer of slurry 2 into the casting box 10. The piping 90 defines an inlet 91 formed in the sidewall 12 of the casting box 10. The inlet 91 is substantially an opening on the sidewall. Preferably, the piping is arranged substantially horizontal, so that at the opening formed by the piping on the sidewall, that is, at the inlet 91, the direction of the flow of slurry is substantially horizontal.

The functioning of the casting apparatus 100 is as follows. A slurry 2, formed preferably mixing and combining tobacco powder and other ingredients, is transferred from a buffer tank (not shown) using for example in line mixers (also not shown) to the casting apparatus 100 inside the casting box 10.

The slurry 2 is supplied via piping 90, which is positioned at a rear or upstream side of casting box 10 (at the first wall 12 of the casting box 10) and the casting blade 70 is located at a front or downstream side of the casting box 10 (near the second wall 14 of the casting box 10). Along the casting direction 24, the slurry has to pass through two rows of fins 25, 26 which are located substantially at the middle of casting box 10, between the first and the second wall 12, 14. The flow is regulated by operating on regulation device 22 which may alter the orientation of fins 25, 26.

The pressure inside the casting box 10 is controlled by positioning the slidable lid 80 which can be raised or lowered along the vertical direction indicated by arrow 85 in FIG. 2 and regulating valve 23; or by letting the lid float on the slurry 2.

The step of casting of the slurry 2 into a web 1 of homogenous and uniform film thickness is performed on the movable support 20, for example the stainless steel belt 7. The casting step includes monitoring the level of slurry in the casting box 10, the moisture of the slurry inside the casting box 10, and the density of the slurry 2, by means of suitable sensors.

The thickness of the web 1 of homogenized tobacco material and grammage controlled by nucleonic gauge immediately after casting are continuously monitored and feedback-controlled using slurry measuring device. The casting is performed by means of casting blade 70 forming a gap with the movable support 20, gap that can also be feedback controlled.

Further, the cast web 1 undergoes a drying step by means of a drying apparatus (not visible in the drawings). The drying apparatus includes a plurality of individual drying zones. Each drying zone preferably includes steam heating on the bottom side of the support and heated air above the movable support 20 and preferably also adjustable exhaust air control. Within the drying apparatus, the homogenized tobacco web 1 is dried to desired final moisture on the support 20.

The drying step includes preferably a uniform and gentle drying of the cast web 1 in an endless, stainless steel belt dryer with individually controllable zones. During the drying, a monitoring step of the temperature of the cast web 1 at each drying zone is preferably performed to ensure a gentle drying profile at each drying zone. The cast web 1 is dried to desired final moisture on the steel belt 20 with steam pan heating from bottom and top air drying. Every drying zone is equipped with steam flow and pressure control and air temperature and air flow are fully adjustable to provide the desired drying profile and ensuring product residence time is respected.

Preferably, at the end of the casting step and of the drying step, the homogenized tobacco web is removed from the support 20. Doctoring of the cast web 1 after the drying station at the right moisture content is preferably performed. The cast web goes preferably through a secondary drying process to remove further moisture content of the web 1 to reach moisture target or specification. Preferably, in this second drying step, the cast web 1 is laid onto a wire, such that moisture can be easily removed from both surfaces of the web 1. After the drying step, the cast web 1 is preferably wound in one or more bobbins in a winding step, for example to form a single master bobbin. This master bobbin may be then used to perform the production of smaller bobbins by slitting and small bobbin forming process. The smaller bobbin may then be used for the production of an aerosol-generating article (not shown).

The invention claimed is:

1. A casting apparatus to cast a web of a material containing alkaloids, the casting apparatus including:

a casting box adapted to contain a slurry to be cast to form the web of a material containing alkaloids, the casting box defining one or more lateral walls;

a slidable lid apt to slide on the one or more lateral walls of the casting box and change an inner volume of the casting box;

a movable support; and a casting blade apt to cast the slurry contained in the casting box onto the movable support so as to form the cast web.

2. The casting apparatus according to claim 1, wherein the slidable lid includes a sealing element to seal the casting box.

3. The casting apparatus according to claim 2, wherein the sealing element is coated or formed in graphene.

4. The casting apparatus according to claim 2, wherein the slidable lid or the casting box includes a pressure valve in order to control a pressure value within the casting box.

5. The casting apparatus according to claim 1, including a plurality of fins, the fins being connected to the slidable lid.

6. The casting apparatus according to claim 5, including a regulation device to change an orientation of the fins, said regulation device being located on a surface of the slidable lid external to the casting box.

7. The casting apparatus according to claim 1, wherein the casting box includes an inlet for the slurry, the inlet for the slurry being formed in one of the one or more lateral walls.

8. The casting apparatus according to claim 1, wherein the slidable lid is substantially horizontal.

9. A method to cast a web of a material containing alkaloids, the method comprising:

providing a casting box defining one or more lateral walls;

providing a casting blade connected to the casting box;

providing a movable support facing the casting blade;

introducing a slurry in the casting box up to a level;

covering the casting box with a slidable lid floating on the slurry, so that the lid changes position to change an inner volume of the casting box when the slurry changes level in the casting box or when a pressure value in the casting box is changed; and casting the slurry on the movable support by means of the casting blade to form the web of material containing alkaloids.

10. The method of claim 9, including the step of sealing the slidable lid onto the casting box.

11. The method according to claim 9, including the step of changing the pressure value inside the casting box.

12. The method according to claim 9, including the steps of providing a plurality of fins attached to the slidable lid.

13. The method according to claim 12, including the step of changing an orientation of the fins.

14. The method according to claim 9, wherein the step of introducing the slurry inside the casting box includes:

introducing the slurry in the casting box along a feeding direction, the feeding direction forming an angle with a horizontal plane comprised between about −45 degrees and about +45 degrees.

15. The method according to claim 9, including the step of keeping a pressure value inside the casting box comprised between about 1 bar and about 10 bar.

* * * * *